US006371109B1

(12) United States Patent
Taylor

(10) Patent No.: US 6,371,109 B1
(45) Date of Patent: Apr. 16, 2002

(54) DIVE MASK PRESSURE RELIEF DEVICE

(76) Inventor: Zachary R. Taylor, 5530 Vista Cantora, Yorba Linda, CA (US) 92887

( * ) Notice: Subject to any disclaimer, the term of this patent is extended or adjusted under 35 U.S.C. 154(b) by 0 days.

(21) Appl. No.: 09/350,819

(22) Filed: Jul. 9, 1999

Related U.S. Application Data

(60) Provisional application No. 60/092,282, filed on Jul. 10, 1998.

(51) Int. Cl.[7] ..... B63C 11/02

(52) U.S. Cl. ..... 128/201.27; 128/201.28

(58) Field of Search ..... 128/200.29, 201.22, 128/201.24–201.29, 200.25, 202.13, 202.15, 206.22; 405/186, 192, 193; 2/428, 426, 430, 446

(56) References Cited

U.S. PATENT DOCUMENTS 2,485,908 A * 10/1949 Morrow ..... 128/142
2,488,235 A * 11/1949 Pfeiffer ..... 2/14
2,918,918 A * 12/1959 Rebikoff ..... 128/142
3,059,637 A * 10/1962 Senne ..... 128/141
3,433,222 A * 3/1969 Pinto ..... 128/142.2
3,958,275 A * 5/1976 Morgan et al. ..... 2/2.1
4,077,068 A * 3/1978 Anderson ..... 2/428
4,187,796 A * 2/1980 Ess ..... 405/193
4,856,120 A 8/1989 Hart ..... 2/428
5,159,923 A * 11/1992 Kaburaki ..... 128/201.27
5,329,643 A 7/1994 Sato ..... 2/428
5,558,466 A * 9/1996 Kuo et al. ..... 405/186
5,564,130 A * 10/1996 Feng ..... 2/428
5,572,989 A * 11/1996 Lutz et al. ..... 128/201.18
5,575,277 A 11/1996 Lutz et al. ..... 128/201.18
5,608,920 A * 3/1997 Oliver et al. ..... 2/428
5,642,529 A * 7/1997 Fujima ..... 2/428
5,860,168 A * 1/1999 Winefordner et al. ..... 2/428
5,890,234 A * 4/1999 Lan ..... 2/428
5,979,441 A * 11/1999 Hsich ..... 128/201.28

* cited by examiner

*Primary Examiner*—John G. Weiss
*Assistant Examiner*—Teena K Mitchell
(74) *Attorney, Agent, or Firm*—Madson & Metcalf

(57) ABSTRACT

A dive mask pressure differential control device is disclosed for protecting a diver from the injurious effects of pressure differentials that can occur inside the dive mask as the pressure of the ambient water increases. The device is pressure sensitive and automatically allows water to pass into the dive mask when the pressure outside the dive mask exceeds the pressure inside the dive mask by a preset limit. In various embodiments, the device may include a manual release, an adjustment mechanism to adjust the activation pressure of the device, a purging mechanism to permit the expulsion of water from the dive mask interior, and a diverter for diverting air bubbles ejected from the device away from the face of the diver.

30 Claims, 7 Drawing Sheets

DIVE MASK PRESSURE RELIEF DEVICE

RELATED APPLICATIONS

This application claims the benefit of U.S. Provisional patent application No. 60/092/282, entitled Dive Mask Pressure Relief Device and filed on Jul. 10, 1998.

BACKGROUND OF THE INVENTION

1. Field of the Invention

The present invention relates to dive masks and more particularly, to novel systems and methods for relieving facial discomfort and injury caused by the pressure differential between the ambient water and the air inside the dive mask.

2. The Relevant Technology

Diving, as a recreational pastime, has been increasing in popularity recently, as more people seek to experience the wonders of underwater life. Many people snorkel, which involves the use of a tube to breathe air from above the surface of the water while the mouth and nose are immersed. Although some snorkelers remain on the surface of the water, others hold their breath while descending to view wildlife that cannot be observed from the surface.

Many people vacationing near large bodies of water also enjoy SCUBA diving. SCUBA, which stands for "self-contained underwater breathing apparatus," identifies a class of equipment, including pressurized air tanks, buoyancy control vests, and air pressure regulators, that allow people to breathe underwater. The equipment permits a SCUBA diver to remain underwater for far longer periods of time than a snorkeler. Indeed, the recreational SCUBA diver may remain immersed for periods of time over an hour and often descend to depths of up to 100 feet under the surface. Professional divers frequently descend to even greater depths.

An important issue for divers, particularly those who venture to greater depths, is the compression of air spaces in and around the diver as ambient water pressure increases.

Because of water's weight, the pressure it will exert on an object increases significantly with depth. All air volumes in contact with the diver's person such as the lungs, the inner ears, and the air space within the dive mask typically start at the surface of the water with a given volume of gas at atmospheric pressure.

As the diver descends into the water, the increase in ambient water pressure imposes loads on all gas volumes. Gas volumes that are not volume-constrained are compressed and reduced in size. Volumes that are constrained in size develop a pressure differential and load across their membrane.

Two important gas volumes that are somewhat volume-constrained are the airspaces of the inner ear and the airspace contained within the dive mask. Pressure loads on the inner ears, the sinuses, the eyes, and the face of the diver can cause discomfort and injury. Injury to the inner ear is avoided by equalizing the pressure in the inner ear. This is done by gently blowing additional air into the inner ear to maintain its volume.

An air space must be maintained within the mask to permit clear underwater vision. The mask is relatively incompressible and is typically sealed to the face by means of a rubber lip. Unless the diver blows additional air into the mask or allows water into it, the pressure against the diver's face will remain at roughly one atmosphere. Consequently, if the diver breathes exclusively through the mouth while descending, without removing any portion of the mask seal, a pressure differential builds across the skin of the diver's face.

This is frequently referred to as "mask squeeze." To avoid mask squeeze, divers are trained to exhale air out through the nose and thus balance the pressure by increasing the amount of air inside the mask. Injury can occur if the diver does not compensate or "equalize" mask pressure in this way. The injuries are typically minor, manifesting themselves as red marks on the face or burst blood vessels in the nose (nosebleeds) or on the surface of the eye (eye-squeeze). In more extreme cases, eyes have been pulled from their sockets, sometimes resulting in permanent blindness. In spite of formal training (which is only a requirement for SCUBA diving certification and not for snorkelers), mask squeeze related injury is a fairly common occurrence. It is easy to be distracted and forget about mask equalization in spite of pain and discomfort.

From the above-discussion, it can be seen that a need exists for a dive mask capable of providing an automatic limitation on the pressure differential between the air inside the mask and the water outside of it. Such a device would enable beginning divers to avoid injury without the need to constantly monitor and adjust the pressure of the mask interior, and would protect even experienced divers in the case of distractions, injury,

BRIEF SUMMARY AND OBJECTS OF THE INVENTION

In view of the foregoing, it is a primary object of the present invention to provide a pressure relief device capable of maintaining the pressure differential across the dive mask at or below a preset level. Consistent with this object, and in accordance with the invention as embodied and broadly described herein, an apparatus and method are disclosed, in suitable detail to enable one of ordinary skill in the art to make and use the invention.

In certain embodiments an apparatus and method in accordance with the present invention may comprise a dive mask pressure relief device. In one embodiment of the present invention, a predetermined pressure differential is maintained by a sealable ingress port and an actuator. The actuator is operably connected with the sealable ingress port to selectively allow outside ambient fluid to pass through the sealable ingress port when pressure outside the dive mask exceeds pressure inside the dive mask by a selected amount.

The dive mask pressure relief device may include additional features to make the pressure control device easier and more convenient to use. For example, an adjustment mechanism can be provided in conjunction with the pressure control device so that the diver can select the maximum allowable pressure differential. A manual release may be included so that the diver can manually allow water into the mask without breaking the mask's perimeter seal. The device can also be incorporated with a purging device to permit rapid evacuation of water from the mask after pressure equalization. Finally, the invention may comprise a bubble diverter designed to keep air bubbles ejected from the mask from obscuring the diver's vision.

In a preferred embodiment of the invention, the pressure relief device is formed by providing an opening in the outer surface of the dive mask. A spring-loaded plugging member or "core" prevents water from entering the opening unless the pressure differential becomes great enough to overcome the force of the spring. In accordance with one contemplated embodiment, the diver can adjust the pressure differential required to permit flow through the opening by adjusting the compression of the spring. In another contemplated embodiment, the diver can manually displace the core from the opening by pressing on a member extending from the core to move the core out of the opening.

A further embodiment permits selective purging of water from the mask by providing an orifice in the core; the orifice is closed unless the diver supplies a higher air pressure in the mask to deflect a flexible flap covering the orifice. An additional embodiment prevents bubbles ejected from the mask during purging from obscuring the diver's vision by providing an enclosure with an angled outlet to channel the bubbles away from the lens of the mask. The advances embodied herein can be combined and used together within the scope and spirit of the invention.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 1(*b*) is a front elevation cross-sectional view of the embodiment of FIG. 1(a), shown in an open position.

FIG. 2(*b*) is a front elevation cross-sectional view of the embodiment of FIG. 2(a), shown in the open position.

FIG. 3(*b*) is a front elevation cross-sectional view of the embodiment of FIG. 3(a), shown in the open position.

FIG. 4(*b*) is a front elevation cross-sectional view of the embodiment of FIG. 4(a), shown in the open position.

FIG. 5(*b*) is a front elevation cross-sectional view of the embodiment of FIG. 5(*a*), shown in a closed position.

FIG. 6(*b*) is a front elevation cross-sectional view of the embodiment of FIG. 6(*a*), shown in an open position.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 8, is not intended to limit the scope of the invention, as claimed, but is merely representative of presently preferred embodiments of the invention.

Those of ordinary skill in the art will, of course, appreciate that various modifications to the details of the Figures may easily be made without departing from the essential characteristics of the invention. Thus, the following description of the Figures is intended only as an example, and simply illustrates one presently preferred embodiment that is consistent with the invention as claimed.

In one embodiment of the present invention, a predetermined pressure differential between the outside of the dive mask and the inside of the dive mask is maintained by a pressure differential control device comprising a sealable ingress port and an actuator. The sealable ingress port and actuator may operate as a one-way valve allowing outside water or other ambient into the dive mask when the vacuum inside the dive mask reaches a predetermined level. In embodiments described herein, the actuator is operably connected with the sealable ingress port to selectively allow outside ambient fluid to pass through the sealable ingress port when pressure outside the dive mask exceeds pressure inside the dive mask by a selected amount. As defined herein, outside ambient may comprise air, water, or other fluids or elements exterior to the dive mask.

The actuator may be as simple as a tethered plug held in an opening by friction or otherwise and displaced by a selected difference in pressure between the inside of the diving mask and the outside of the diving mask. Other examples will be described in detail herein.

Figure 1A:
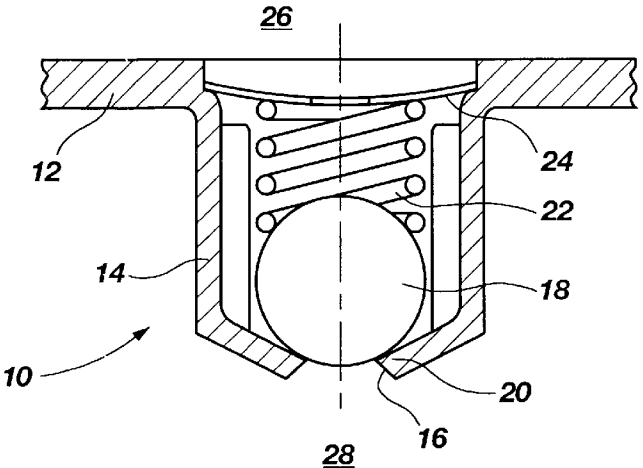
FIG. 1(*a*) is a front elevation cross-sectional view of one embodiment of the invention comprising a spring-loaded spherical core blocking fluid flow above a predetermined pressure differential, shown in a closed position.
Figure 1B:
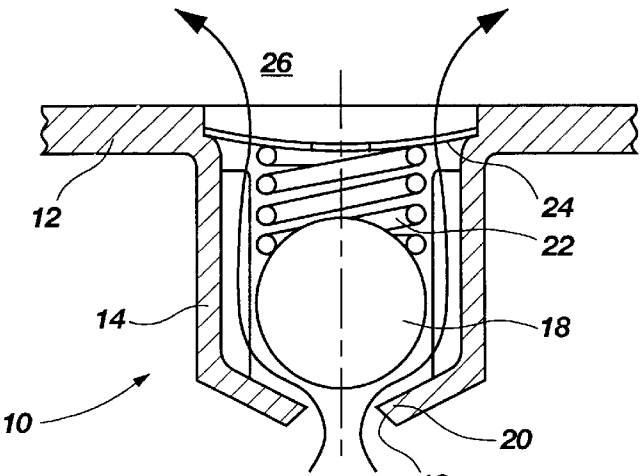

In one embodiment, shown in FIGS. 1(*a*) and 1(*b*), the sealable ingress port comprises an opening 16 and the actuator comprises a spherical member and a resistive member. The spherical member is shown in the form of a spherical core 18 and the resistive member is shown as comprising a helical spring 22.

In FIGS. 1(*a*) and 1(*b*), the dive mask comprises a surface 12 extending away from the diver's face ("outward") to form a housing 14 with the opening 16 disposed at an end of the housing 14 distal from the diver's face. The spherical core 18 is situated within the housing 14. The opening 16 is shaped to form a seat 20 for centering the spherical core 18 and providing a tight, fluid-sealed interface with the spherical core 18. The spring 22 presses against the spherical core 18 to hold it tightly against the seat 20. The spring 22, in turn, is held in place by a spring retainer 24 mounted within the housing 14.

The pressure differential control device 10 shown in FIG. 1(*a*) is normally sealed against fluid passage by the pressure of the spherical core 18 against the seat 20. The air 26 inside the mask combines with the pressure of the spring 22 to press against the inner surface of the spherical core 18, while the water 28 surrounding the mask pushes in toward the face of the diver ("inward"), against the outside of the spherical core 18 where it is exposed by the opening 16. When the pressure of the water 28 exceeds that of the spring 22 and the air 26 by an amount sufficient to overcome the force of the spring 22, the spherical core 18 moves from the seat 20 to open the opening 16 and allow the ingress of water 28 into the dive mask interior. This situation is shown in FIG. 1(*b*), wherein the arrows represent water 28 entering the dive mask via the opening 16.

The water 28 entering the dive mask increases the pressure inside the dive mask until the pressure in the dive mask, combined with the force of the spring 22, is great enough to push the spherical core 18 back into the seat 20, thereby restricting the further ingress of water into the dive mask. Thus, the pressure differential control device 10 allows water 28 to selectively pass into the dive mask until the pressure differential between the water 28 and the air 26 has been returned to a safe level, after which the pressure differential control device 10 resumes its seal.

Once the pressure differential is returned to a desired level, the diver can remove the water from the dive mask. This can be accomplished in several manners. The air can be removed by blowing air into the dive mask through the nose and removing the dive mask from the face at the bottom edge. As air is lighter than water, the air expelled into the dive mask forces water out of the bottom and the diver can then reseal the dive mask. Alternatively, the diver can use a purging device, certain embodiments of which will be described herein.

The spherical core 18 described above is one of many different plugging members that can be used in accordance with the present invention to block the sealable ingress port (opening 16). Additionally, the spring 22, the spherical core 18, and the seat 20 form one possible means of the present invention for selectively passing outside ambient through a sealable ingress port.

Additional examples of a means for selectively passing outside ambient through a sealable ingress port or opening include a flap urged against the opening by deflection of the flap, a pivoting member removably covering the opening, a translating member removably covering the opening, a compartment of compressible fluid situated to move a member against the opening, an electric rotary or linear motor situated to move a member against the opening, a hydraulic or pneumatic motor situated to move a member against the opening, a piston system for conversion of an input pressure to a higher or lower output pressure, and a computer control system for sensing the pressure differential and controlling the actuator accordingly.

Figure 2A:
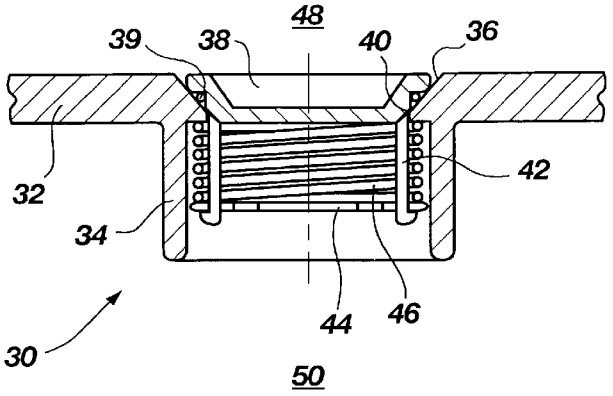
FIG. 2(*a*) is a front elevation cross-sectional view of an alternate embodiment of the invention comprising a disk-shaped core, shown in the closed position.
Figure 2B:
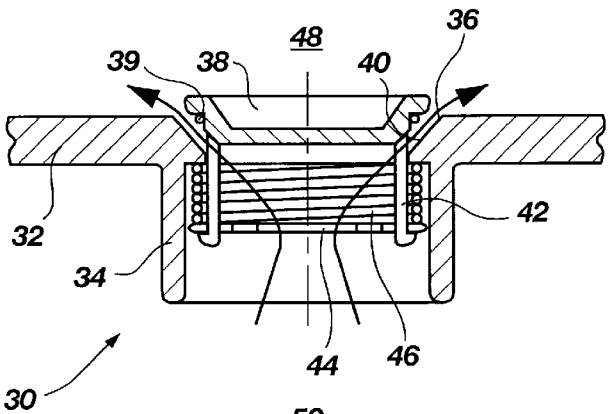

FIG. 2(*a*) shows an alternate embodiment of the invention in a closed position sealing the dive mask from water. The pressure differential control device 30, as in the previous embodiment, comprises a protrusion from the surface 32 of the dive mask in the form of a housing 34. An opening 36 is formed in the surface 32 for selectively allowing fluid passage into the dive mask. A disk 38 has sloping sides that allow it to fit snugly into the opening 36. An elastomeric seal in the shape of a ring 39 encircles the disk 38. The sloping surface of the opening 36 forms a seat 40 where the ring 39 on the disk 38 presses against it to maintain the fluid seal.

Struts 42 affixed to the disk 38 extend into the housing 34 to retain a plate 44. A spring 46 presses against the plate 44 and the surface 32 of the dive mask, placing the struts 42 in tension and thereby holding the disk 38 in the opening 36. In this position, the air 48 inside the dive mask is isolated from the water 50 surrounding the dive mask.

The air 48 and the spring 42 exert an outward force on the disk 38, sealing the disk 38 against the opening 36. Balancing against this outward force is a force exerted by the outside water 50 which pushes against the outside surface of the disk 38. When the pressure exerted by the outside water 50 pressure is great enough to overcome the opposing force of the air 48 and the spring 42, the disk 38 is pushed away from the opening 36, allowing ingress of the outside water 50 into the opening 36.

FIG. 2(*b*) shows the embodiment of FIG. 2(*a*) in the open position in which water is permitted to flow into the dive mask. As with the previous embodiment, water flows into the dive mask until the pressure differential between the air 48 and the water 50 has reached a selected level. The diver can also press directly against the plate 44 to manually open the pressure differential control device 30 when the activation pressure differential has not yet been reached.

Figure 3A:
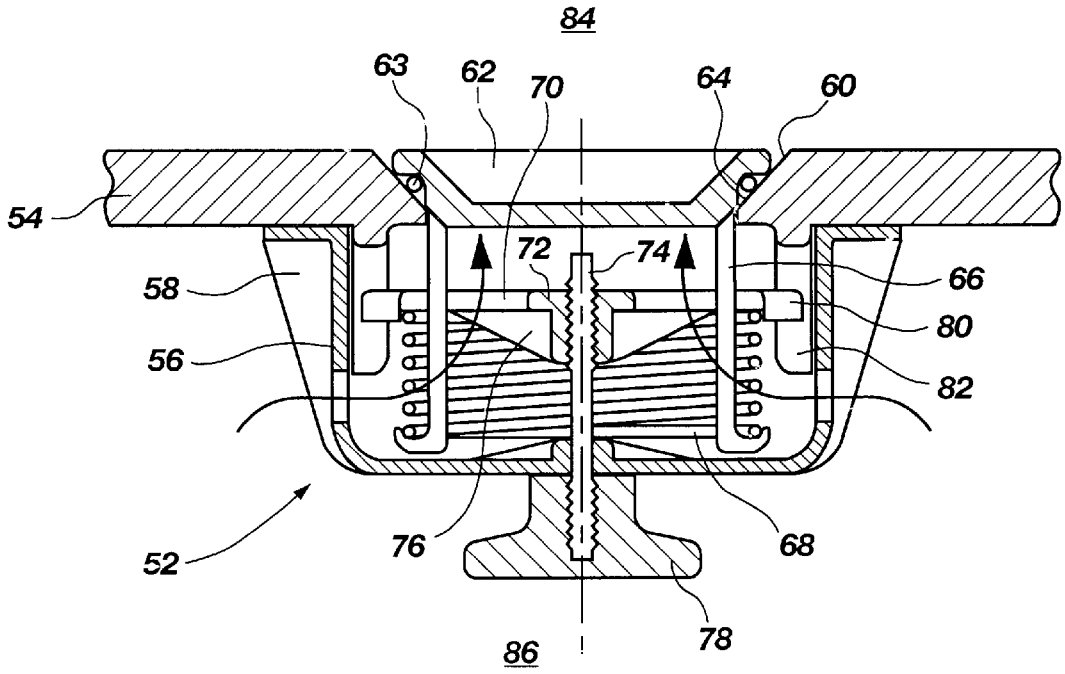
FIG. 3(*a*) is a front elevation cross-sectional view of an embodiment of the invention comprising an adjustment knob for adjusting the activation pressure differential, shown in the closed position.
Figure 3B:
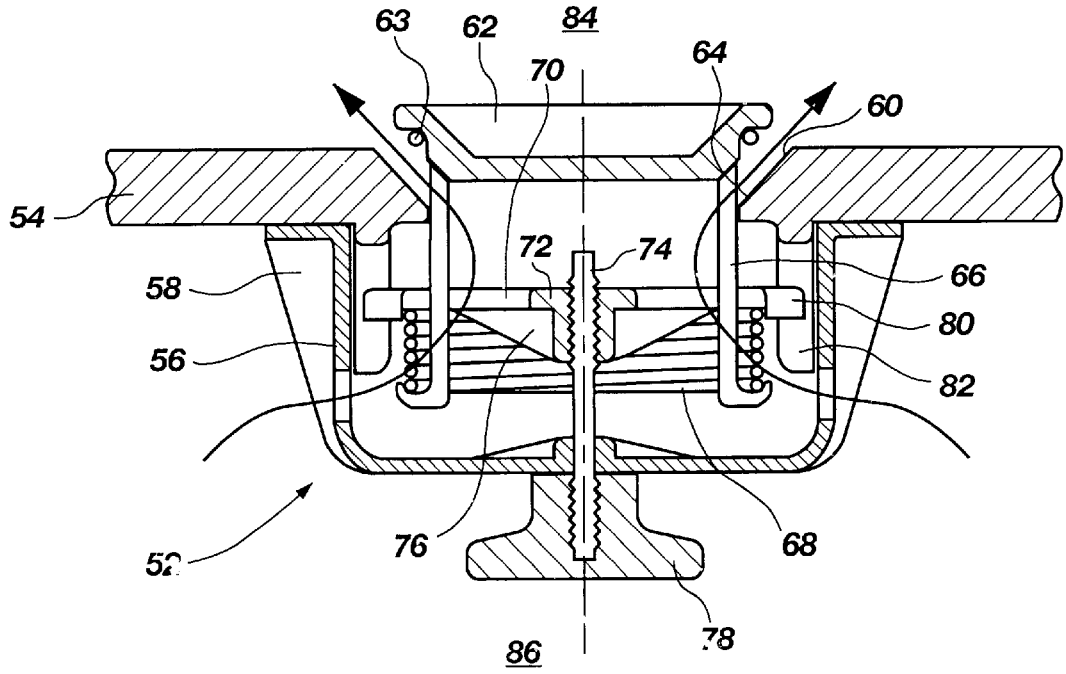

FIG. 3(*a*) shows a third embodiment of the present invention. In FIG. 3, the pressure differential control device 52 comprises an adjustment mechanism for adjusting the pressure differential required to activate the pressure differential control device 52. As with the previous embodiment, a housing 56 protrudes outward from the surface 54 of the dive mask. The housing 56 can be unitary with the surface 54 or it can be a separate piece, as depicted in FIG. 3(*a*). Gussets 58 can also be added to strengthen the housing 56 or provide for easier mounting.

An opening 60 is formed in the surface 54, and a disk 62 and ring 63 of elastomeric material are situated within the opening 60, the sides of which form a seat 64 for the disk 62 and the ring 63. Struts 66 extend outward from the disk 62 to retain a spring 68. The spring 68 presses against the struts 66 and a plate 70. The plate 70 is held in place by a threaded portion 72 of the plate 70 engaging the threads of a pin 74. Gussets 76 formed in the plate 70 are attached to the threaded portion 72 of the plate 70 and increase the stiffness and strength of the plate 70. The pin 74 extends outward through a small hole in the housing 56 to anchor in a knob 78.

The compression of the spring 68 can be adjusted by turning the knob 78, which causes the pin 74 to rotate within the threaded portion 72 of the plate 70. The plate 70 is kept from rotating by tabs 80 situated in slots formed by splines 82 running along the length of the housing 56. As the pin 74 rotates, the plate 70 translates inward or outward. When the knob is turned to move the plate 70 inward, the spring 68 relaxes and pulls the disk 62 into the seat 64 with less force. Thus, a lower pressure differential between the air 84 and the water 86 is required to open the pressure differential control device 52.

When the knob is turned in the opposite direction, the plate 70 moves to compress the spring 68 more tightly, thereby requiring a higher pressure differential to open the pressure differential control device 52. The knob 78 can be provided with markings indicating the selected activation pressure differential. FIG. 3(*b*) shows the pressure differential control device 52 in the open position; the plate 70 remains in place while the struts 66 move inward to permit the disk 62 to move from the opening 60.

Figure 4A:
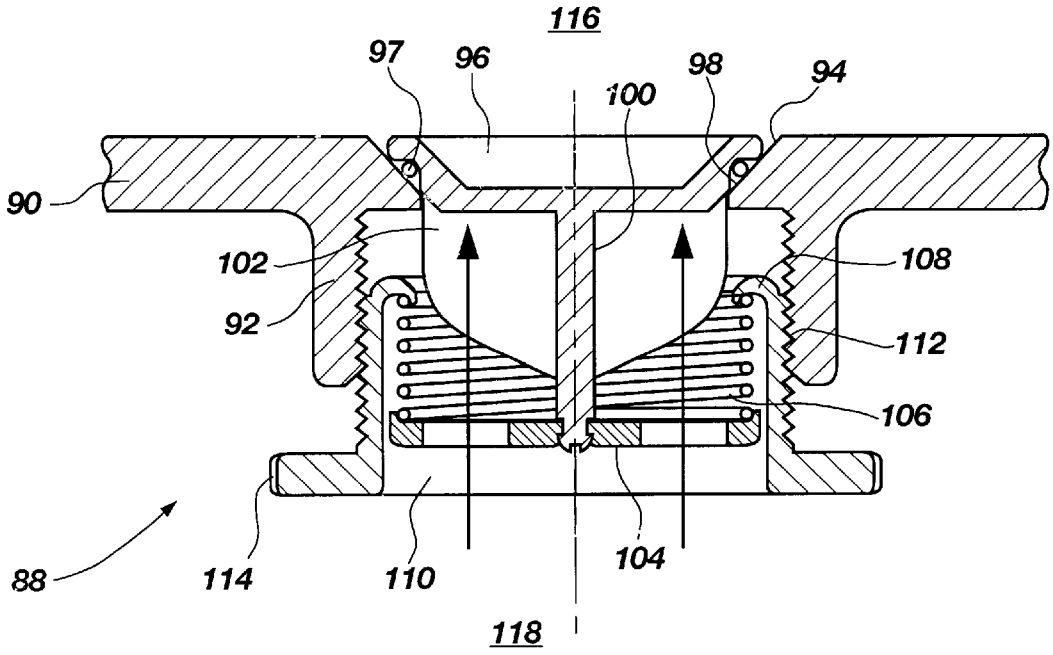
FIG. 4(*a*) is a front elevation cross-sectional view of an embodiment of the invention comprising an adjustment dial for adjusting the activation pressure differential and a manual release for manual activation, shown in the closed position.
Figure 4B:
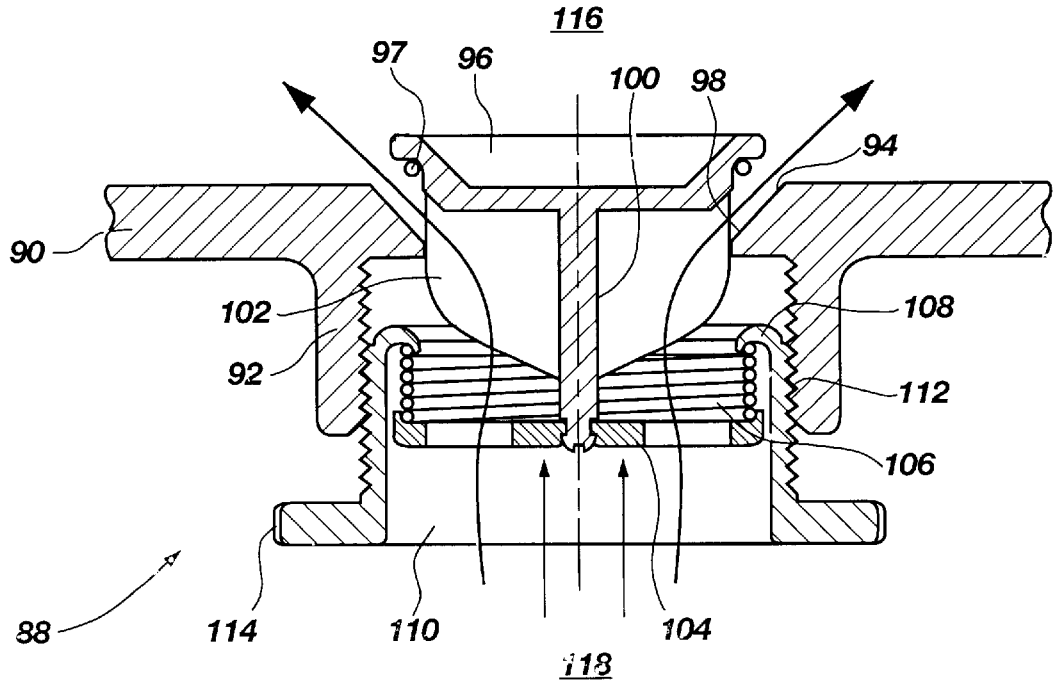

FIG. 4(*a*) shows a further alternate embodiment of the invention. The pressure differential control device 88 of FIG. 4(*a*) is adjustable and also comprises a manual release similar to that of the embodiment of FIG. 2(*a*). As with prior embodiments, the surface 90 of the dive mask protrudes to form a housing 92. An opening 94 in the surface 90 is blocked by a disk 96 with a ring 97. Preferably, the disk 96 and the ring 97 are disposed against a seat 98 in the opening 94.

A pin 100 extends outward from the disk 96, and gussets 102 provide structural support for the pin 100 and ensure that the disk 96 is aligned properly with the seat 98. The pin 100 is anchored at its outward end to a plate 104. A spring 106 is compressed between the plate 104 and a lip 108 on the inward end of a dial member 110. A threaded portion 112 on the dial member 110 engages a similar portion on the inside wall of the housing 92.

When the dial member 110 is rotated, the threads cause the dial member to move inward or outward. When the dial member 110 moves inward, the lip 108 moves toward the disk 96, thereby easing the compression of the spring 106 and permitting the pressure differential control device 88 to open at a lower pressure differential. Ridges 114 can be disposed on the dial member 110 to permit easier gripping and rotation by the diver. The dial member 110 can also include markings to show the selected activation pressure differential.

The diver may also manually open the pressure differential control device 88 by pressing inward on the plate 104, and thereby pushing the disk 96 out of the opening 94 to permit flow into the air 116 of the dive mask interior from the water 118 surrounding the diver. FIG. 4(*b*) shows the pressure differential control device 88 in the open position. The thicker arrows represent water flow and the thinner arrows show the direction and location of pressure applied to manually open the pressure differential control device 88.

Figure 5A:
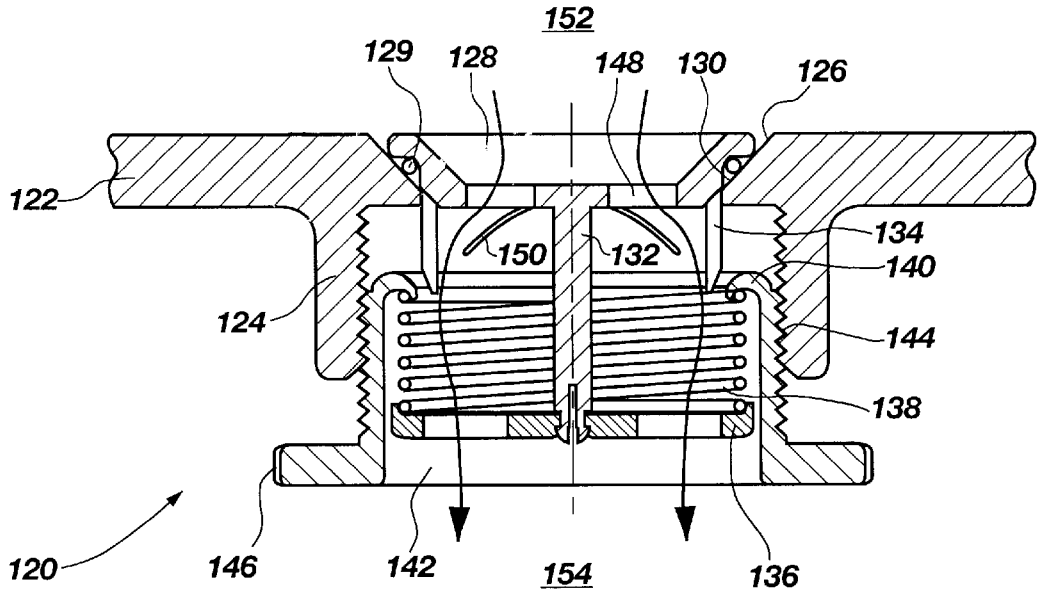
FIG. 5(*a*) is a front elevation cross-sectional view of an embodiment of the invention comprising an adjustment dial for adjusting the activation pressure differential, a purging orifice for venting excess pressure from the mask, and a manual release for manual activation, shown in an open position.
Figure 5B:
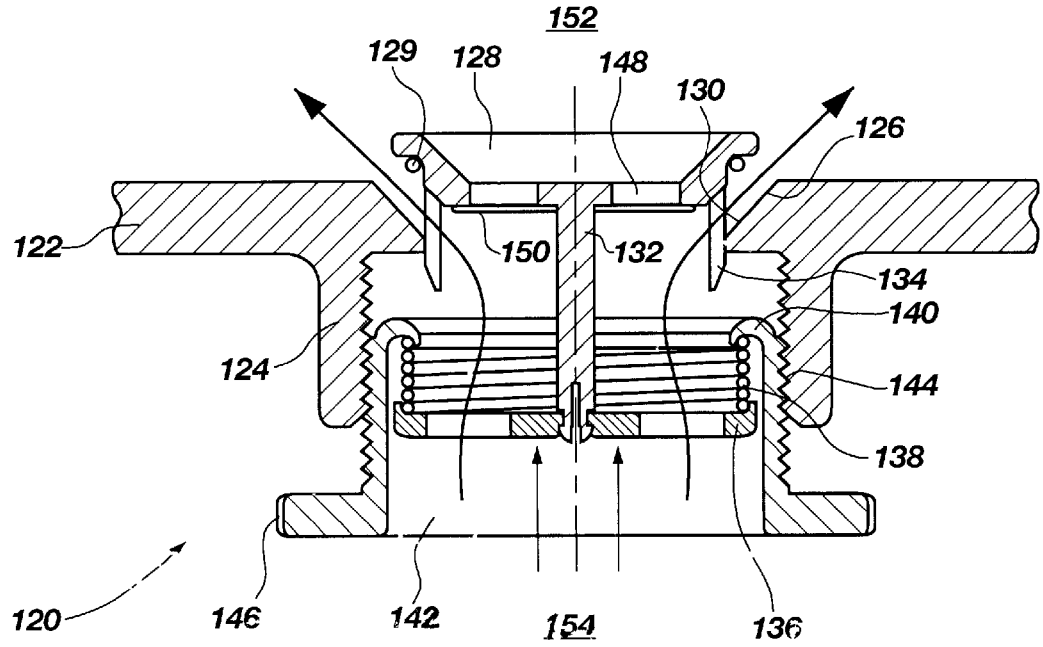

FIG. 5(*a*) shows another alternate embodiment of the invention incorporating a purging mechanism for ejecting water from the dive mask. The pressure differential control device 120 includes a surface 122 of the dive mask, a housing 124, an opening 126, a disk 128, a ring 129, a seat 130, and a pin 132 similar to those disclosed in connection with the embodiment of FIG. 4. The gusset 102 has been replaced by struts 134 to align the disk 128 without impeding fluid flow from the disk 128. As in the previous embodiment, a plate 136 retains and compresses a spring 138 against the lip 140 of a dial member 142. The dial member 142 has a threaded portion 144 in engagement with the housing 124 and ridges 146 to facilitate gripping and rotation by the diver.

In addition to the adjustment mechanism and manual release disclosed in connection with the previous embodiment, this embodiment includes a purging mechanism. The purging mechanism may comprise an orifice 148 in the disk 128 with a flap 150 mounted to the outer side of the disk 128. The flap 150 preferably forms a disk that deflects under pressure to form a domed, umbrella shape. In FIG. 5(*a*), the air 152 inside the dive mask is at a higher pressure than the water 154 surrounding it. Accordingly, the flap 150 is pressed into its dome-shaped configuration by the pressure of the air 152, permitting the air 152 and associated water to leave the interior of the dive mask through the orifice 148. The diver is thus permitted to eject water from the interior of the dive mask by orienting the pressure differential control device 120 at the lowest position of the dive mask and blowing into the dive mask through the nose. The increased pressure of the air 152 opens the flap 150 to force the water out of the dive mask.

When the pressure of the water 154 exceeds that of the air 152, the flap 150 will remain in its disk shape, thereby covering the orifice 148. As with previously-described embodiments, the pressure differential control device 120 opens when the pressure of the water 154 exceeds that of the air 152 by an amount great enough to overcome the force of the spring 138. FIG. 5(*b*) shows the pressure differential control device 120 with the opening 126 open for water inflow, but with the orifice 148 closed to restrict outflow.

Figure 6A:
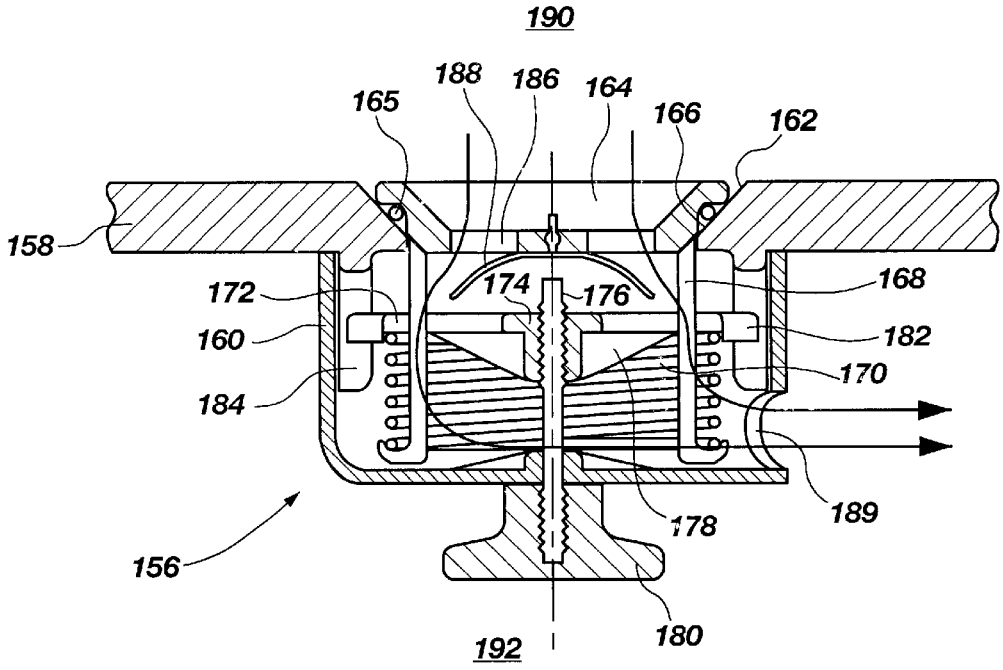
FIG. 6(*a*) is a front elevation cross-sectional view of an embodiment of the invention comprising an adjustment knob for adjusting the activation pressure differential, a purging orifice for venting excess water from the mask, and a shaped cover for directing bubbles away from the lens, shown in a closed position.
Figure 6B:
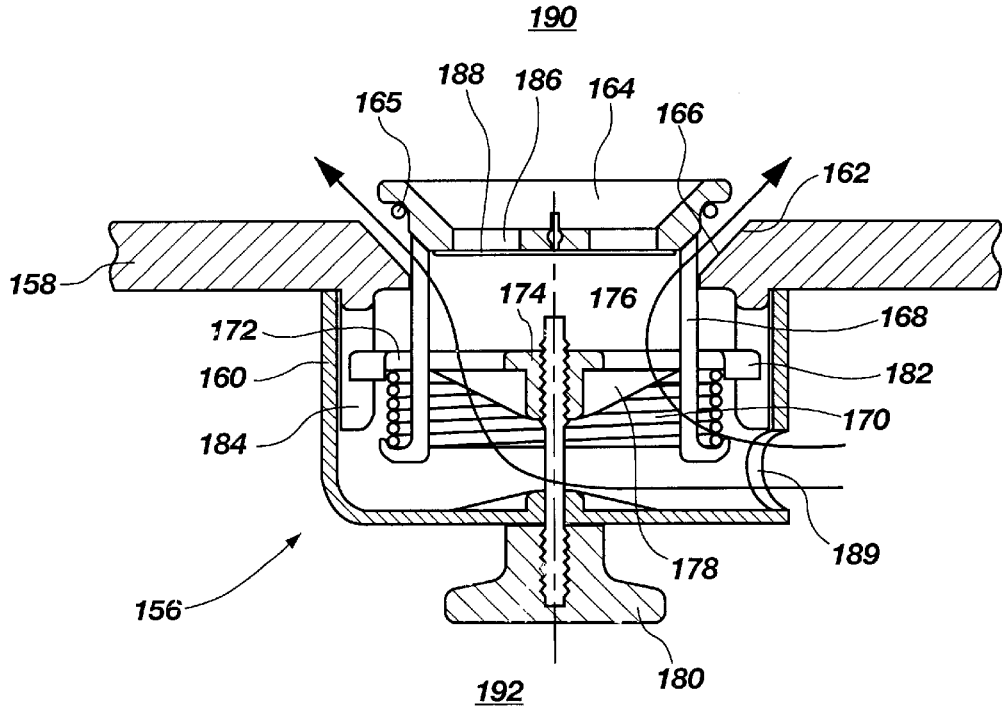

One potential problem with the purging device is that bubbles may be ejected from the dive mask, and may float up in front of the dive mask, obscuring the diver's vision. FIG. 6(*a*) shows a pressure differential control device 156 configured to remedy this problem. The pressure differential control device 156 of this embodiment includes many of the same components as those of the embodiment of FIG. 3. Common features include the surface 158 of the dive mask, the housing 160, the opening 162 in the surface 158, the disk 164, the ring 165, the seat 166, the struts 168, the spring 170, the plate 172, the threaded portion 174 of the plate 172, the pin 176, the gusset 178, the knob 180, the tabs 182, and the splines 184. The embodiment shown in FIG. 6(*a*) also includes a purging mechanism, similar to that of the previous embodiment, comprising an orifice 186 and a flap 188.

In addition, the housing of the embodiment shown in FIG. 6(*a*) differs from that of FIG. 3(*a*) in that it comprises an outlet 189 that has been specially positioned to direct outflowing air bubbles away from the dive mask so as to avoid obscuring the diver's vision. In FIG. 6(*a*), the flap 188 is open to permit the air 190 and water inside the dive mask to pass into the water 192 outside the dive mask. FIG. 6(*b*) shows the pressure differential control device 156 in the open position so that water enters the dive mask.

Figure 7:
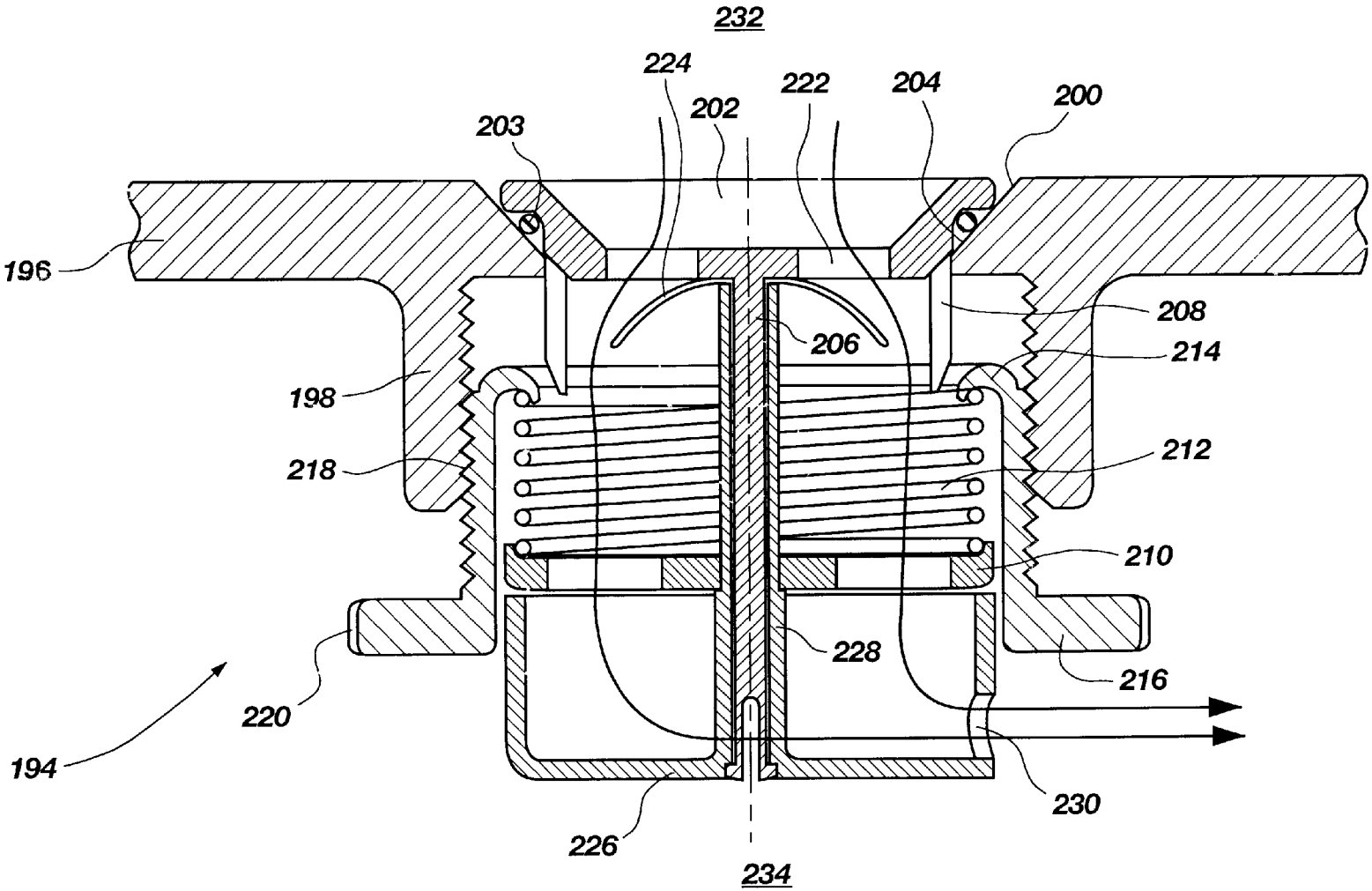
FIG. 7 is a front elevation cross-sectional view of an embodiment of the invention comprising an adjustment dial for adjusting the activation pressure differential, a purging orifice for venting excess water from the mask, and a manual release for manual activation which also functions as a shaped cover for directing bubbles away from the lens, shown in a closed device, open purge position.

FIG. 7 shows another alternate embodiment. The pressure differential control device 194 of FIG. 7 is provided with an adjustment mechanism, a manual release, a purging mechanism, and a bubble diverter. Many of the features disclosed in connection with the embodiment of FIG. 5(*a*) are also present here. Common components include the surface 196 of the dive mask, the housing 198, the opening 200, the disk 202, the ring 203, the seat 204, the pin 206, the struts 208, the plate 210, the spring 212, the lip 214, the dial member 216, the threaded portion 218, the ridges 220, the orifice 222, and the flap 224.

As shown in FIG. 7, the pressure differential control device 194 also includes an enclosure 226 fastened to the outward side of the plate 210. The enclosure 226 is fastened by the pin 206, which extends through the plate 210 and through a tube 228 in the enclosure 226 to anchor in the outward surface of the enclosure 226. An outlet 230 in the enclosure 226 is positioned to direct the flow of bubbles away from the diver's face. As shown in FIG. 7, fluid is allowed to flow from the air 232 inside the dive mask, through the outlet 230, and into the water 234 surrounding the diver.

Figure 8:
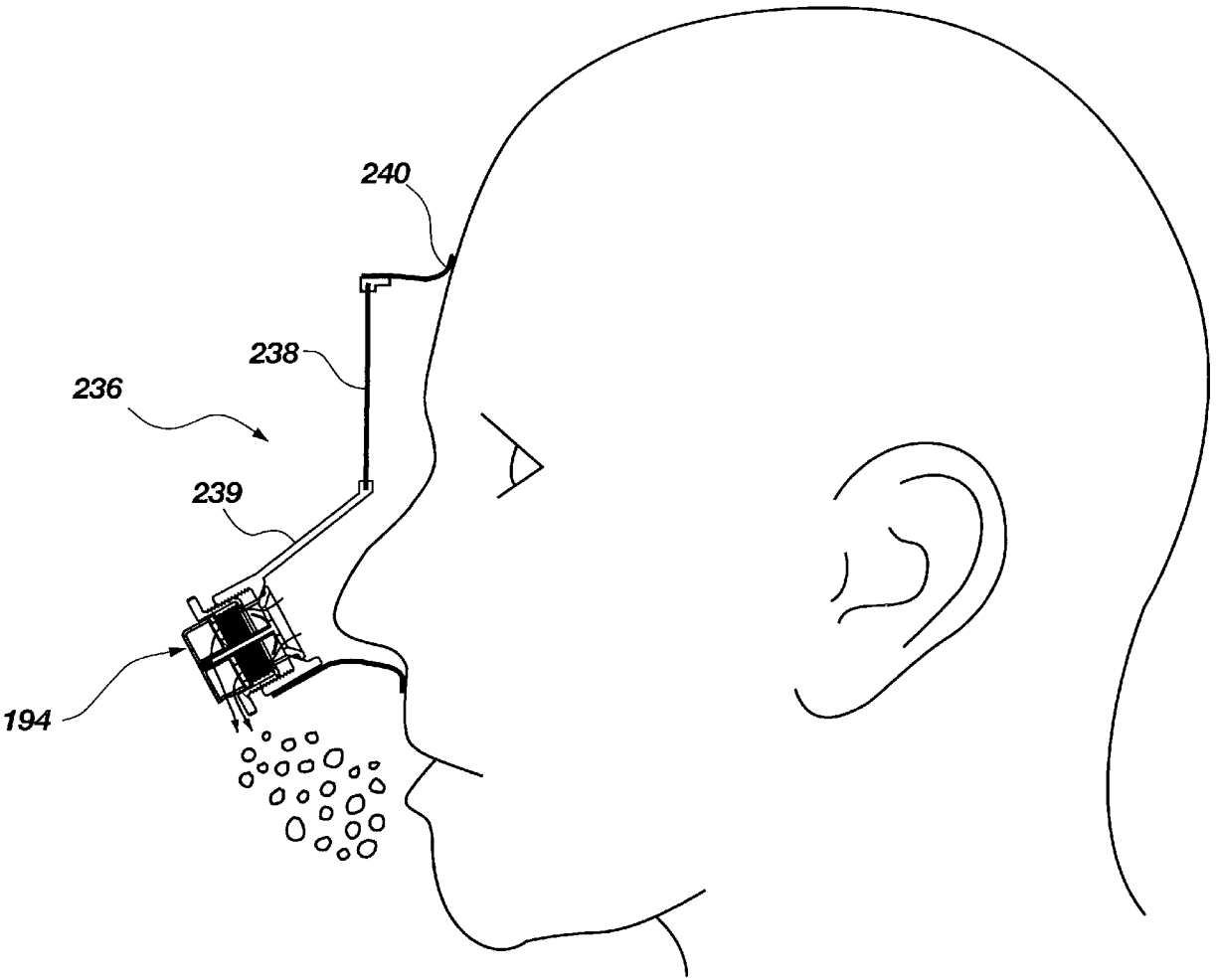
FIG. 8 is a side elevation cross-sectional view of the embodiment of FIG. 7 mounted in a mask affixed to the face of a diver.

FIG. 8 shows the embodiment of FIG. 7 in use by a diver. A mask 236 is attached to the diver's face by a strap or another means of attachment known in the art. A clear lens 238 is positioned in front of the diver's eyes. The pressure differential control device 194 is mounted in a nosepiece 239 extending forward of the diver's nose. Thus, when the diver's head is right-side up and oriented normally, as when the diver is looking straight ahead, straight down, or somewhere in between, the pressure differential control device 194 is near the bottom of the dive mask 236. As a result, when the diver blows through the nose to increase the pressure inside the dive mask, water is pushed downward by the pressurized air to exit the dive mask 236 through the pressure differential control device 194.

The outlet 230 is shown positioned on the bottom side of the pressure differential control device 194 to force bubbles ejected from the pressure differential control device 194 towards the rear and sides of the dive mask 236. The dive mask 236 is sealed to the face of the diver by the seal 240, which can comprise a rubber lip, a gasket, a foam pad, or another means known in the art for comfortably sealing a mask to the face of a diver.

From the above discussion, it will be appreciated that the present invention provides numerous features that may be used singly or in various selected combinations. Some of the features that may be used in any combination include: a pressure-operated actuator situated to permit water to flow into the dive mask when the pressure differential reaches a preset level, a manual release device, a mechanism for adjusting the activation pressure of the actuator, a purge valve for forcing water out of the dive mask, and a bubble diverter for diverting a stream of bubbles exiting the dive mask away from the lens area.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for providing a safe or comfortable pressure within a dive mask which, in use, has an exterior surface that is exposed to water, the apparatus comprising:

a sealable ingress port adapted to be disposed within the exterior surface of the dive mask for selectively allowing outside surrounding water into the dive mask; and an actuator operably connected with the sealable ingress port to selectively allow outside water to pass through the sealable ingress port when pressure outside the dive mask exceeds pressure inside the dive mask by a user-selected amount.

2. The apparatus of claim 1, wherein the actuator comprises a core, and further comprising an elastomeric member disposed between the sealable ingress port and the core, wherein the elastomeric member opens the ingress port when pressure outside the dive mask exceeds pressure inside the dive mask by a user-selected amount.

3. The apparatus of claim 1, wherein the actuator comprises a substantially spherical member adapted to be sealably received by the sealable ingress port.

4. The apparatus of claim 3, further comprising a housing attached to the exterior surface of the dive mask which exposes the sealable ingress port to the surrounding water.

5. The apparatus of claim 4, further comprising a resistive member providing a biasing force against the dive mask and against the spherical member for urging the spherical member against the sealable ingress port.

6. The apparatus of claim 5, wherein the housing comprises an adjustment mechanism to adjust the biasing force of the resistive member.

7. The apparatus of claim 1, wherein the actuator comprises a substantially disk-shaped core.

8. The apparatus of claim 7, wherein the sealable ingress port is formed by a substantially round hole in the exterior surface of the dive mask, wherein the substantially round hole is sized to sealably receive the core therein.

9. The apparatus of claim 9, wherein the actuator comprises a strut for retaining a first resilient member.

10. The apparatus of claim 9, further comprising a compressive member positioned to provide a biasing force against the exterior surface of the dive mask and the strut.

11. The apparatus of claim 10, further comprising an adjustment mechanism attached to the compressive member for adjusting the biasing force of the compressive member.

12. The apparatus of claim 11, further comprising a release mechanism affixed to the actuator and adapted to open the sealable ingress port upon actuation by a user.

13. The apparatus of claim 12, wherein the actuator comprises an orifice, selectively sealable by a second resilient member disposed on the actuator, wherein the orifice is opened to permit fluid flow therethrough when the inside pressure exceeds the outside pressure by a user-selected amount.

14. The apparatus of claim 13, further comprising a diverter operably connected to the dive mask to direct a stream of air bubbles out of the housing.

15. The apparatus of claim 11, wherein the actuator comprises an orifice selectively sealable by a second resilient member disposed on the actuator, wherein the orifice is adapted to open and permit air or water flow therethrough when the inside pressure exceeds the outside pressure by a user-selected amount.

16. The apparatus of claim 15, further comprising a diverter operably connected to the dive mask to direct a stream of air bubbles to exit the dive mask through the orifice.

17. The apparatus of claim 1, further comprising a release mechanism affixed to the actuator and adapted to move the actuator away from the sealable ingress port upon actuation by a user.

18. The apparatus of claim 1, wherein the actuator comprises an orifice selectively sealable by a second resilient member disposed on the actuator, wherein the orifice is adapted to open and permit air or water flow therethrough when the inside pressure exceeds the outside pressure by a user-selected amount.

19. The apparatus of claim 18, further comprising a diverter operably connected to the dive mask to direct a stream of air bubbles to exit the dive mask through the orifice.

20. An apparatus for providing a safe or comfortable pressure in a dive mask which, in use, has an interior airspace and an exterior surface that is exposed to water, the apparatus comprising:

a sealable ingress port disposed within the exterior surface of the dive mask; and a means for selectively passing outside water through the sealable ingress port into the interior airspace when pressure outside the dive mask exceeds pressure inside the dive mask by a preset amount.

21. The apparatus of claim 20, wherein the means for selectively passing outside water through the sealable ingress port comprises a core sized to be sealably received by the sealable ingress port.

22. The apparatus of claim 21, wherein the means for selectively passing outside ambient water through the sealable ingress port further comprises an elastomeric seal disposed between the sealable ingress port and the core.

23. The apparatus of claim 21, wherein the core comprises a hardened sphere.

24. The apparatus of claim 21, wherein the means for selectively passing outside ambient water through the sealable ingress port further comprises a resilient member disposed to urge the core into the sealable ingress port.

25. The apparatus of claim 24, wherein the resilient member comprises a helical spring for providing a substantially linear force urging the core against the sealable ingress port.

26. The apparatus of claim 24 wherein the resilient member comprises an elastomeric spring for providing a substantially linear force for urging the core against the sealable ingress port.

27. A dive mask comprising:

a surface adapted to be disposed between an interior volume of air and outside water for maintaining a seal between the air and the water;

a housing integrated into the surface of the dive mask;

an sealable ingress port disposed in the housing;

a core disposed within the housing receivable by the sealable ingress port to selectively restrict outside water from passing through the sealable ingress port; and a spring disposed to urge the core against the sealable ingress port and restrict water passage through the sealable ingress port when pressure outside the dive mask exceeds pressure inside the dive mask by less than a user-selected amount.

28. The dive mask of claim 27, further comprising an adjustment member rotatably attached to the housing for adjusting movement of the spring as it urges the core against the sealable ingress port.

29. The dive mask of claim 28, further comprising a selectively sealable orifice, for expulsion of air and trapped water through the housing when the pressure exerted by the interior volume of air exceeds the pressure exerted by the surrounding water by a user-selected amount.

30. The dive mask of claim 29, further comprising a diverter operably connected to the dive mask to direct air bubbles expelled through the housing away from a field of view of a user.

* * * * *

UNITED STATES PATENT AND TRADEMARK OFFICE

CERTIFICATE OF CORRECTION

PATENT NO. : 6,371,109 B1
DATED : April 16, 2002
INVENTOR(S) : Zachary Taylor

It is certified that error appears in the above-identified patent and that said Letters Patent is hereby corrected as shown below:

Column 2,
Line 27, after "injury" please insert -- unconsciousness, etc. --

Column 10,
Line 12, delete "9" and replace it with -- 8 --.

Signed and Sealed this

Twenty-seventh Day of January, 2004

JON W. DUDAS
*Acting Director of the United States Patent and Trademark Office*